US006505029B2

(12) United States Patent
Ishizaki et al.

(10) Patent No.: US 6,505,029 B2
(45) Date of Patent: Jan. 7, 2003

(54) IMAGE FIXING APPARATUS AND THIN TUBE-LIKE ENDLESS FILM HAVING INNER AND OUTER LAYERS

(75) Inventors: Akira Ishizaki, Osaka (JP); Yoshinari Takayama, Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 09/798,904

(22) Filed: Mar. 6, 2001

(65) Prior Publication Data

US 2001/0019677 A1 Sep. 6, 2001

(30) Foreign Application Priority Data

Mar. 6, 2000 (JP) ..... 2000-060702

(51) Int. Cl.[7] ..... G03G 15/20
(52) U.S. Cl. ..... 399/333; 219/216
(58) Field of Search ..... 399/328, 329, 399/331, 333, 335, 338; 430/97, 99; 219/216; 428/36.91

(56) References Cited

U.S. PATENT DOCUMENTS

| | | | | |
|---|---|---|---|---|
| 5,411,779 A | | 5/1995 | Nakajima et al. | 428/36.91 |
| 5,697,037 A | * | 12/1997 | Yano et al. | 399/333 |
| 5,765,085 A | * | 6/1998 | Law et al. | 399/329 |
| 6,075,228 A | * | 6/2000 | Goto et al. | 219/216 |

FOREIGN PATENT DOCUMENTS

| | | |
|---|---|---|
| JP | A-7-178741 | 7/1995 |
| JP | A-8-80580 | 3/1996 |
| JP | A-8-118561 | 5/1996 |
| JP | A-10-186923 | 7/1998 |

* cited by examiner

*Primary Examiner*—Hoan Tran
(74) *Attorney, Agent, or Firm*—Sughrue Mion, PLLC

(57) ABSTRACT

An image fixing apparatus using an endless film in which abrasion resistance is largely improved by presence of the high-hardness releasable resin outer layer so that the endless film is provided with practically satisfactory mechanical strength as well as satisfactory abrasion resistance, whereby the image fixing apparatus can obtain a sharp image for a long term; and to provide such an image-fixing endless film for use in the image fixing apparatus.

3 Claims, 3 Drawing Sheets

IMAGE FIXING APPARATUS AND THIN TUBE-LIKE ENDLESS FILM HAVING INNER AND OUTER LAYERS

BACKGROUND OF THE INVENTION

1. Field of the Invention

The present invention relates to an image fixing apparatus for fixing a non-fixed toner image in an apparatus of an electrophotographic system, such as a copying machine, a laser beam printer, a facsimile equipment, or the like, and further relates to an image-fixing endless film for use in such an image fixing apparatus.

2. Background Art

Heat roll fixing is heretofore known as a method for fixing an image on a recording material in an image forming apparatus of an electrophotographic system. As shown in FIG. 1, the system uses a structure in which a heat source 12 such as a halogen heater is disposed inside a core 11 of at least one roll 10 of a pair of rolls and in which at least one layer of a heat-resistant elastic body 13 is provided on the core 11. In the system, the layer of the elastic body 13 excellent in elasticity is provided on the at least one roll 10 and a higher nipping pressure is applied to the roll 10 in order to widen the area of a nip portion formed for applying solderless contact on a non-fixed toner image 5. However, if the roll excellent in elasticity was used under a high temperature while a high nipping pressure was applied to the roll, there was a problem in durability that the elasticity of the roll deteriorated. Further, in the case where such a pair of rolls as shown in the system were used, it was necessary to provide a drive/driven control mechanism (not shown) on at least one end portion of the rolls in order to make the rolls rotate at the same linear velocity. The control mechanism was a cause of disturbance against the miniaturization of the apparatus.

Therefore, a fixing system using an endless film has been developed for the purposes of: shortening waiting time; saving electric power; and reducing the size of the apparatus. FIG. 2 shows an example of such a fixing system. As shown in FIG. 2, a seamless type endless film 2 is fitted on the outside of a stay 1. A pressure roll 4 is disposed so as to face a heater 3 built in the stay 1. A recording material 6 having a non-fixed toner image 5 temporarily attached thereto is fed in between the endless film 2 and the pressure roll 4. As a result, the non-fixed toner image 5 is melted through the endless film 2 by heat of the heater 3, so that a fixed image 7 is formed. According to this system, the endless film 2 may be made thinner and a heat-conductive filler may be filled in the endless film 2 in order to enhance its heat conductivity. Hence, heat of the heater 3 can be immediately transmitted to the recording material through the endless film 2. Hence, the temperature of the film surface can be immediately raised up to a predetermined value compared with the heat roll fixing system. Accordingly, there is an advantage in that waiting time can be shortened and consumed electric power can be reduced.

As such an endless film for use in such a belt fixing system, there is known a complex tube-like material in which an outer layer of a material made of a heat-resistant resin such as polyimide excellent in heat resistance and mechanical strength is coated with a releasable resin outer layer made of a fluororesin excellent in high-temperature characteristic and toner releasability. There is further known an endless film having film stiffness which is controlled by improvement of heat conductivity at the time of fixing through heat-conductive particles contained in the heat-resistant resin forming the inner layer, or which is controlled by adjustment of monomer components of polyimide (see JP-A-8-80580 and JP-A-7-186162). In those endless films specifically disclosed in those publications as mentioned above, there was however no sufficient consideration of abrasion resistance of the releasable resin outer layer. It was found that fixing failure due to abrasion of the outer layer occurred in fixing under a high-pressure and high-temperature condition with the advance of printing speed in recent years.

On the other hand, in order to improve abrasion resistance of the releasable resin outer layer, it is conceived that a fluororesin having a melting viscosity of not lower than $1\times10^4$ poise and having a relatively high molecular weight is preferable as the resin to be used in the outer layer.

According to the inventors' experiment, it was however proved that a coating film excellent in abrasion resistance, high in density, and high in hardness could not be obtained when a fluororesin high in molecular weight was merely used. Even in the case where a coating film high in hardness (for example, a coating film having Vickers hardness of not lower than 12 Hv) was obtained, it was also however proved that the effect to improve abrasion resistance of the endless film surface was small when the inner layer of the tube-like material was high in stiffness. These problems were remarkable because the stiffness of the film became high particularly in the case where a large amount of filler powder such as heat-conductive inorganic powder was mixed with the heat-resistant resin layer of the film as shown in the image fixing apparatus in which heating was performed through the film.

On the other hand, when the stiffness of the inner layer of the endless film was made low, the low stiffness was favorable to abrasion. However, a member (not shown) for regulating an edge portion of the endless film so as to control zigzag (meandering) movement of the endless film might be provided for reducing the size of the apparatus. There was another problem that buckling or bending of the film itself and worsening of carrying characteristic might be caused by contact of the film with the member.

SUMMARY OF THE INVENTION

It is therefore an object of the present invention to provide an image fixing apparatus using an endless film in which abrasion resistance is largely improved by presence of the high-hardness releasable resin outer layer so that the endless film is provided with practically satisfactory mechanical strength as well as satisfactory abrasion resistance, whereby the image fixing apparatus can obtain a sharp image for a long term; and to provide such an image-fixing endless film for use in the image fixing apparatus.

To achieve the foregoing object, the inventors of the present invention have made various researches on causes of abrasion of the endless film surface and measures against the abrasion in addition to the aforementioned findings. As a result, it has been found that not only the stiffness of the material but also the flexibility of the tube-like material has a large influence on abrasion. It has been further found that satisfactory abrasion resistance can be obtained in cooperation with the effect of the high-hardness releasable resin outer layer when the flexibility of the tube-like material is in a specific range in terms of ring-crash compression load. Thus, the present invention has been accomplished.

That is, according to an aspect of the present invention, there is provided an image fixing apparatus comprising a drive roll, and an endless film facing the drive roll so as to be in external contact with the drive roll to thereby form a nip portion therebetween, wherein: the endless film is a thin tube-like material which includes a heat-resistant resin tube-like inner layer containing heat-conductive particles, and a releasable resin outer layer formed on an outer surface of the heat-resistant resin tube-like inner layer; the releasable resin outer layer has a coating film hardness of not lower than 12 Hv, preferably 12 to 30 Hv, more preferably 12 to 25 Hv, in terms of Vickers hardness; the thin tube-like material has a tensile modulus of elasticity of not smaller than 6000 $N/mm^2$, preferably 6000 to 15000 $N/mm^2{}_1$, more preferably 6000 to 10000 $N/mm^2$; and a ring-crash compression load of the tube-like material is not higher than 5.0 g (4900 dyn), preferably 2.0 to 5.0 g, the ring-crash compression load being a load which is given when a tube-like material having a length of 40 mm is compressed vertically so that a vertical diameter (h) of the tube-like material is deformed to be halved (h'=h/2)

In the above image fixing apparatus, preferably, the drive roll is used as a pressure roll; a heat source is provided inside the endless film; and a non-fixed toner image is heated and fixed through the endless film at the nip portion formed between the drive roll and the endless film.

On the other hand, according to another aspect of the present invention, there is provided an image-fixing endless film comprising a thin tube-like material which includes a heat-resistant resin tube-like inner layer containing heat-conductive particles, and a releasable resin outer layer formed on an outer surface of the heat-resistance resin tube-like inner layer, wherein: the releasable resin outer layer has a coating film hardness of not lower than 12 Hv, preferably 12 to 30 Hv, more preferably 12 to 25 Hv, in terms of Vickers hardness; the thin tube-like material has a tensile modulus of elasticity of not smaller than 6000 $N/mm^2{}_1$ preferably 6000 to 15000 $N/mm^2$, more preferably 6000 to 10000 $N/mm^2$; and a ring-crash compression load of the tube-like material is not higher than 5.0 g, preferably 2.0 to 5.0 g, the ring-crash compression load being a load which is given when a tube-like material having a length of 40 mm is compressed vertically so that a vertical diameter (h) of the tube-like material is deformed to be halved (h'=h/2).

In the image fixing apparatus according to the present invention, though the tensile modulus of elasticity of the endless film is not smaller than 6000 $N/mm^2$, satisfactory abrasion resistance can be obtained while practically satisfactory mechanical strength is kept, because the ring-crash compression load of the endless film is not higher than 5.0 g. That is, in the belt fixing type image fixing apparatus in which a small-size film is used for the purpose of making the apparatus compact, the flexibility of the tube-like material as a whole is generally reduced when the stiffness of the inner layer of the tube-like material is high. Hence, the contact area of a portion of the tube-like material which is in external contact with the roll is small, so that the contact pressure of the portion becomes high. In such a manner, shearing stress applied on the interface between the tube-like material and the recording material becomes high correspondingly, so that the abrasion of the releasable resin outer layer surface is apt to advance. However, if the ring-crash compression load is not higher than 5.0 g, the flexibility of the tube-like material becomes good, and the shearing stress applied on the interface becomes therefore low. Accordingly, abrasion resistance of the tube-like material can be made good in cooperation with the effect of the outer layer having a Vickers hardness of not lower than 12 Hv. Moreover, though the flexibility is high, carrying characteristic, or the like, is hard to be deteriorated as described above because the tensile modulus of elasticity is not smaller than 6000 $N/mm^2$. As a result, an image fixing apparatus that can obtain a sharp image for a long term can be provided by use of the endless film having practically satisfactory mechanical strength and having satisfactory abrasion resistance. Hence, reduction in size of the image fixing system and increase in speed thereof as described above can be achieved.

When the drive roll is used as a pressure roll and a heat source is provided inside the endless film so that a nip portion is formed between the drive roll and the endless film, and when a non-fixed toner is heat-fixed through the endless film, the effect of the present invention is made particularly remarkable by use of the endless film having abrasion resistance as described above so that an abrasion problem of the film apt to occur due to shearing stress applied on the interface can be solved.

On the other hand, as described above, in the image-fixing endless film according to the present invention, the ring-crash compression load of the endless film is not higher than 5.0 g though the tensile modulus of elasticity thereof is not smaller than 6000 $N/mm^2$. Hence, satisfactory abrasion resistance can be obtained while mechanical strength is kept practically satisfactory in cooperation with the effect of the outer layer having a Vickers hardness of not lower than 12 Hv.

DESCRIPTION OF THE PREFERRED EMBODIMENT

Figure 1:
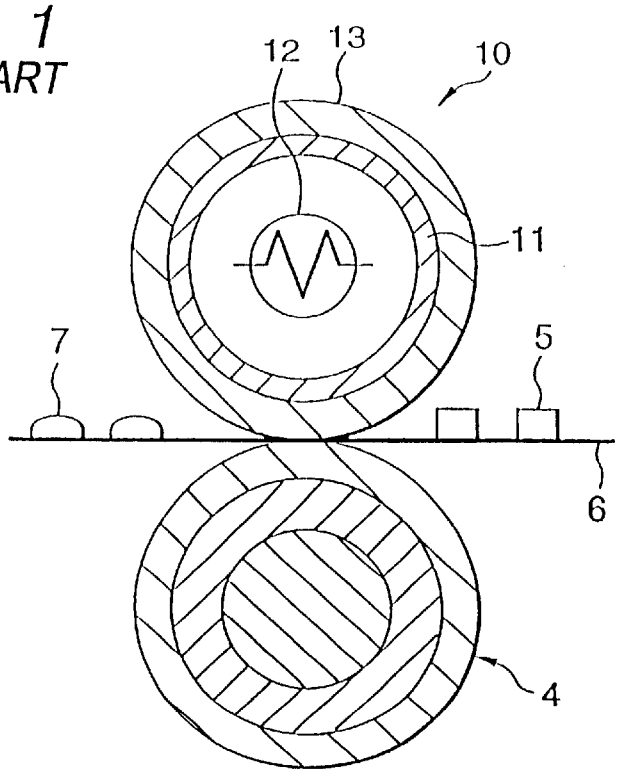
FIG. 1 PRIOR ART
FIG. 1 is a sectional view showing a background-art image fixing apparatus using a heat roll fixing system.
Figure 2:
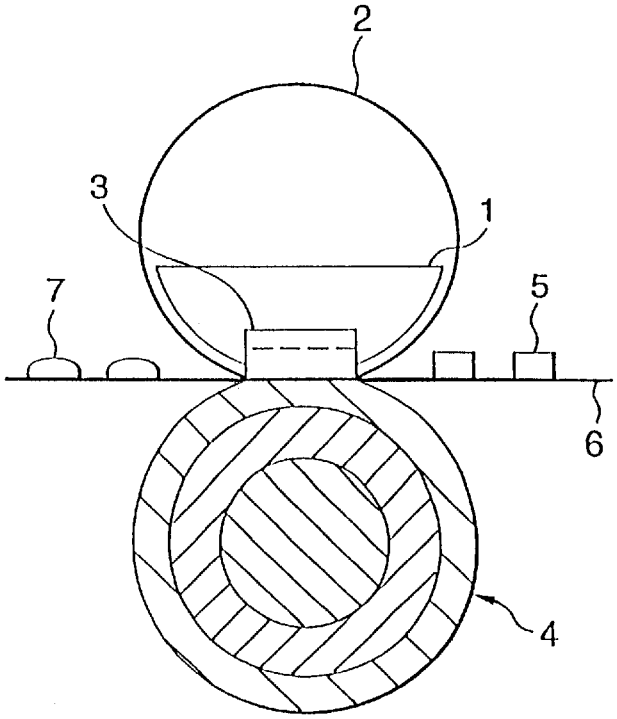
FIG. 2 is a sectional view showing an example of an image fixing apparatus according to the present invention.

An embodiment of the present invention will be described below with reference to the drawings. FIG. 2 is a sectional view showing an example of the image fixing apparatus according to the present invention.

The image fixing apparatus according to the present invention may be formed to have any configuration so long as an endless film 2, which will be described later, is in external contact with a drive roll 4 opposite to the endless film 2 so that a nip portion is formed therebetween. It is preferable to employ a structure in which the drive roll 4 is used as a pressure roll and a heat source 3 is provided inside the endless film 2 so that a nip portion is formed between the drive roll 4 and the endless film 2.

Specifically, as shown in FIG. 2, the endless film 2, which will be described later, is fitted on the outside of a stay 1. The pressure roll 4 is disposed so as to face the heater 3 such as a ceramic heater built in the stay 1. Thus, a nip portion is formed between the pressure roll 4 and the endless film 2. A recording material 6 having a non-fixed toner image 5 temporarily attached thereto is fed to the nip portion between the endless film 2 and the pressure roll 4. Hence, the non-fixed toner image 5 is heated and melted through the endless film 2 by the heat of the heater 3. Thus, a fixed image 7 is formed.

In this case, the endless film 2 is driven by the rotation of the pressure roll 4 so that the recording material 6 is fed. Incidentally, a member for regulating an edge portion of the endless film 2 may be provided on the end portion of the stay 1 in order to prevent zigzag (meandering) movement of the endless film 2.

The endless film according to the present invention is adapted to the aforementioned image fixing apparatus. The endless film is a thin tube-like material, which has a heat-resistant resin tube-like inner layer, and a releasable resin outer layer. The heat-resistant resin tube-like inner layer contains heat-conductive particles. The releasable resin outer layer is formed on the outer surface of the heat-resistant resin tube-like inner layer. The thicknesses of the respective layers may be set suitably. The thickness of the inner layer is preferably selected to be in a range of from 30 to 100 $\mu$m while the thickness of the outer layer is preferably selected to be in a range of from 5 to 30 $\mu$m. If the outer layer is thinner than 5 $\mu$m, the life up to occurrence of offset when recording paper is fed is apt to be shortened.

The heat-resistant resin tube-like inner layer contains, as a resin component, a heat-resistant resin the shape of which can be retained at a fixing temperature. For example, a heat-resistant resin such as polyimide, polyamide-imide, polyether-ether-ketone, polyphenylene sulfide, polybenzimidazole, or the like, may be used. Especially, a polyimide resin excellent in mechanical characteristic, heat resistance and bending characteristic is most preferable. For example, the polyimide resin can be prepared as follows. Tetracarboxylic dianhydride which is an acid component and approximately equimolar diamine which is an amine component are dissolved in a suitable solvent and made to react with each other so that a polyamic acid solution is produced. After the solvent is removed, the polyamic acid solution is further polymerized (converted to imide) at a high temperature. Thus, the polyimide resin can be obtained. Aromatic polyimide is preferably used as the polyimide. For example, the kind, molar ratio, etc. of the carboxylic dianhydride and diamine to be used may be adjusted to obtain moderate stiffness. The stiffness of the inner layer can be reduced as the monomer components which are high in bending characteristic are copolymerized in high molar ratio. This rule can be applied also to the other resins.

A functional filler such as heat-conductive particles, electrically conductive particles, slidability improving particles, or the like, can be mixed with the heat-resistant resin tube-like inner layer as occasion demands. Particularly when a heat source is disposed in the inside of the endless film constituting the nip portion, heat-conductive particles may be preferably added for the purpose of heat conduction through the film. When scale-like or fiber-like boron nitride is used as the heat-conductive particles in this case, heat conductivity can be improved preferably. The heat tube-like inner layer preferably contains the heat-conductive particles in an amount of 20 to 50 wt %. In the present invention, attention must be paid to the following compression load range so that sufficient flexibility can be obtained even in the case where the aforementioned functional filler is mixed.

On the other hand, the releasable resin outer layer can be made of a fluororesin such as polytetrafluoroethylene, tetrafluoroethylene-perfluoroalkylvinyl ether (PFA), or the like. The fluororesin to be used is a material the molecular weight of which is adjusted so that a coating film hardness of not lower than 12 Hv, preferably not lower than 13 Hv can be obtained in terms of Vickers hardness. A fluororesin having a melting viscosity of $5\times10^4$ poise at 380° C. is generally preferable because the fluororesin has a sufficient coating film strength not lower than 12 Hv. If the coating film strength is lower than 12 Hv, abrasion resistance of the releasable resin outer layer required as the object of the present invention cannot be obtained. Incidentally, from the point of view to make the Vickers hardness high, it is preferable to use a fluororesin small in primary particle size so that the coating film is made dense by heating sufficiently.

Incidentally, the Vickers hardness is measured at an indentation depth in a range of from 1 to 2 $\mu$m and at an indentation velocity of 21 nm/sec by a Vickers hardness meter (MH-400, made by NEC Corporation) with a triangular indentater having a ridge angle of 80°.

The releasable resin outer layer may be further filled with a suitable filler such as an electrically conductive material, inorganic fine particles, or the like, for the double purpose of offset characteristic of toner and abrasion resistance without departing from the scope of the object of the present invention. Incidentally, the outer surface of the heat-resistant resin tube-like inner layer may be preferably subjected to suitable surface treatment such as primer treatment to enhance the binding force of the releasable resin outer layer. The primer layer may contain an electrically conductive material.

Further, in the present invention, it is important that the tensile modulus of elasticity of the tube-like material is not smaller than 6000 N/mm$^2$ and the ring-crash compression load thereof is not higher than 5.0 g. If the tensile modulus of elasticity of the tube-like material is smaller than 6000 N/mm$^2$, there is a fear that bending of the edge portion of the endless film or buckling of the film may occur because of contact of the endless film with the shift-regulating member disposed on the edge portion of the endless film. Incidentally, in the case of an endless film have an ordinary thickness, an ordinary outer diameter, etc., it is preferable that the tensile modulus of elasticity of the tube-like material is smaller than 6800 N/mm$^2$ after the ring-crash compression load is adjusted to be within the aforementioned range.

If the ring-crash compression load is higher than 5.0 g, there is a risk that uniform contact pressure cannot be obtained in the contact surface and that the abrasion of the releasable resin layer may be apt to advance as described above because the flexibility of the tube-like material is deteriorated. It is preferable from this point of view that the ring-crash compression load is selected to be not higher than 4.0 g.

Figure 3:
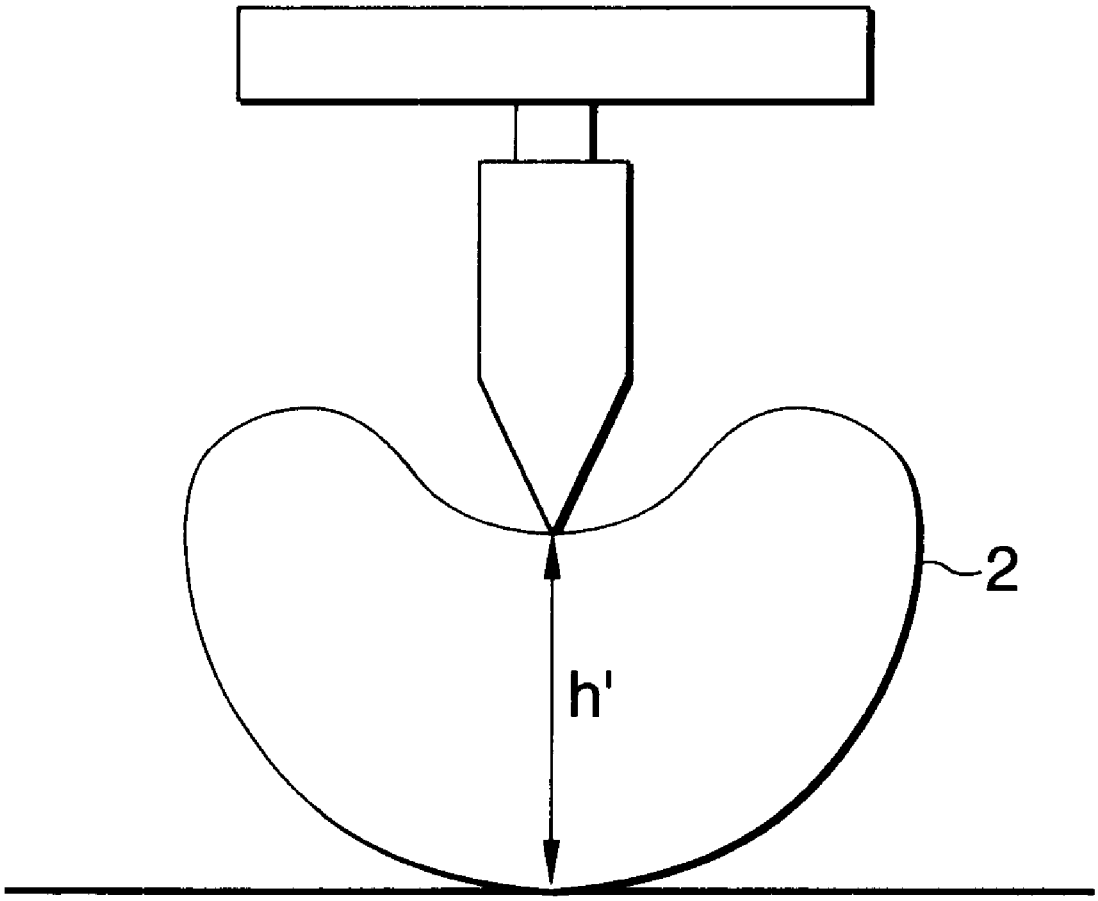
FIG. 3 is a schematic view for explaining a method for measuring a ring-crash compression load.
Figure 4:
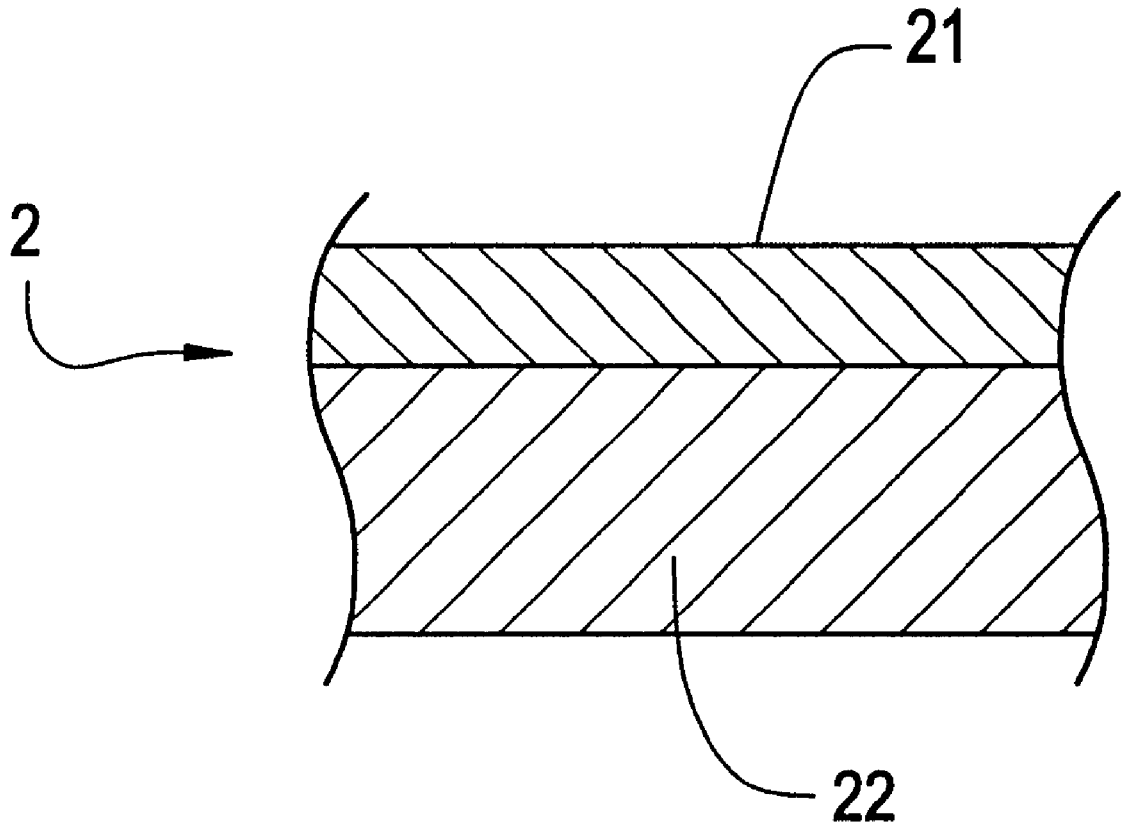
FIG. 4 depicts the structure of the endless film, as shown in FIG. 2, in more detail. Item 21 represents the outer layer whereas item 22 represents the inner layer.

As shown in FIG. 3, the ring-crash compression load is measured as a load which is given when a tube-like material with a length of 40 mm is compressed vertically so that the vertical diameter (h) of the tube-like material is deformed be halved (h'=h/2). Incidentally, the tensile modulus of elasticity is calculated by measurement in the longitudinal direction of the tube-like material in accordance with JISK-7127 (1999).

The ring-crash compression load is mainly affected by the thickness and bending stiffness of the heat-resistant resin tube-like inner layer and also affected by the outer diameter of the endless film. Hence, the ring-crash compression load is particularly useful as a physical property for evaluating the total flexibility of the endless film and as an index different from the tensile modulus of elasticity which is heretofore used as an index of the stiffness of the endless film.

EXAMPLES

Examples specifically showing the configuration and effect of the present invention and Comparative Examples will be described below. Incidentally, the aforementioned method for measuring physical properties is used in Examples and Comparative Examples.

Example 1

In 791.6 g of N-methyl-2-pyrolidone, 100 parts by weight of a polyimide resin solid content and 30 parts by weight (49.4 g) of hexagonal-system boron nitride were mixed and stirred. Then, 117.6 g of 3,3',4,4'-biphenyltetracarboxylicdianhydride, 21.6 g of p-phenylenediamine and 40.0 g of 4,4'-diaminodiphenyl ether were further mixed therewith. The mixture was polymerized while stirred in a nitrogen atmosphere at room temperature for 7 hours. Thus, a polyamic acid solution was prepared. In the above description, the molar ratio of p-phenylenediamine (diamine exhibiting stiffness) to 4,4'-diaminodiphenyl ether (diamine exhibiting flexibility) was 5 to 5.

The polyamic acid solution was applied onto an inner circumferential surface of a cylindrical mold having an inner diameter of 30 mm and a length of 500 nm. A running body shaped like a bullet was moved down to the mold by its own weight and then rotated at a rotational speed of 1500 rpm for 10 minutes to thereby obtain a uniform coating film thickness. Then, the film was heated at 150° C. for about 60 minutes until the film could be supported by itself. Thus, removal of the solvent and partial conversion to imide were performed. The film was released from the mold. The endless film thus formed was put on a pipe. An electrically conductive primer and a fluororesin (PFA, made by Du Pont-Mitsui Polychemicals Co., Ltd.) having a melting viscosity of $3\times10^5$ poise were applied on the outer surface of the endless film by spray coating. Then, the primer and the fluororesin were heated gradually to 350° C. and kept at 350° C. for 20 minutes, so that sintering of the primer and the fluororesin, removal of the residual solvent and water generated by dehydration according to ring-closure and reaction for completion of imide conversion were performed at once. Thus, a thin tube-like material having a polyimide group layer about 50 μm thick and a fluororesin layer about 12 μm thick was obtained. The The tensile modulus of elasticity of the tube-like material was measured in accordance with JIS K-7127 (1999). As a result, the average tensile modulus of elasticity was 6600 N/mm . On the other hand, the ring-crash compression load of the tube-like material was 3.3 g and the Vickers hardness thereof was 13 Hv.

The tube-like material was set in an image fixing apparatus (fixing temperature: about 200° C.) which was of the type shown in FIG. 2 and which was capable of delivering 15 sheets per minute. A copying test was performed in the condition that the image fixing apparatus was operated continuously. As a result, there was no abrasion observed in the releasable resin surface even after the passage of 3 weeks. Moreover, the fixed image was so sharp that the apparatus was excellent in fixing characteristic.

Example 2

A thin tube-like material was produced in the manner similar to that in Example 1 except that the time of retention at 350° C. after spray coating was 40 minutes. That is, a thin tube-like-material having a polyimide group layer about 50 μm and a fluororesin layer about 12 μm was obtained. The tensile modulus of elasticity of the tube-like material was measured in accordance with JIS K-7127 (1999). As a result, the average tensile modulus of elasticity was 6500 N/mm. On the other hand, the ring-crash compression load of the tube-like material was 3.5 g and the Vickers hardness thereof was 16 Hv. A copying test was performed in the condition that the image fixing apparatus was operated continuously in the same manner as that in Example 1. As a result, there was no abrasion observed in the releasable resin surface even after the passage of 3 weeks. Moreover, the fixed image was so sharp that the apparatus was excellent in fixing characteristic.

Comparative Example 1

A thin tube-like material was produced in the manner similar to that in Example 1 except that the molar ratio of diamine exhibiting stiffness to diamine exhibiting flexibility was selected to be 8 to 2. The tensile modulus of elasticity of the tube-like material was measured in accordance with JIS K-7127 (1999). As a result, the average tensile modulus of elasticity was 7300 $N/mm^2$. On the other hand, the ring-crash compression load of the tube-like material was 5.4 g and the Vickers hardness thereof was 13 Hv. A copying test was performed in the condition that the image fixing apparatus was operated continuously in the same manner as that in Example 1. As a result, abrasion marks which were apparently caused by contact stress between the elastic member and the recording material were observed from place to place in the releasable resin surface after the passage of about 2 weeks. Moreover, the sharpness of the image in portions corresponding to the abrasion marks was deteriorated compared with Examples 1 and 2.

Comparative Example 2

A thin tube-like material was produced in the manner similar to that in Example 1 except that the fluororesin applied on the outer surface of the endless film by spray coating was replaced by a fluororesin (PFA, made by Daikin Kogyo Co., Ltd.) having a melting viscosity of $1\times10^4$ poise. The tensile modulus of elasticity of the tube-like material was measured in accordance with JIS K-7127 (1999). As a result, the average tensile modulus of elasticity was 6500 $N/mm^2$. On the other hand, the ring-crash compression load of the tube-like material was 3.5 g and the Vickers hardness thereof was 11 Hv.

A copying test was performed in the condition that the tube-like material was operated continuously in the same manner as that in Example 1. As a result, abrasion marks which were apparently caused by contact stress between the elastic member and the recording material were observed from place to place in the releasable resin surface after the passage of about 2 weeks. Moreover, the sharpness of the image in portions corresponding to the abrasion marks was deteriorated compared with Examples 1 and 2.

Comparative Example 3

A thin tube-like material was produced in the manner similar to that in Example 1 except that the molar ratio of diamine exhibiting stiffness to diamine exhibiting flexibility was selected to be 8 to 2. The tensile modulus of elasticity of the tube-like material was measured in accordance with JIS K-7127 (1999). As a result, the average tensile modulus of elasticity was 5500 $N/mm^2$. On the other hand, the ring-crash compression load of the tube-like material was 2.8 g and the Vickers hardness thereof was 13 Hv. A copying test was performed in the condition that the image fixing apparatus was operated continuously in the same manner as in Example 1. As a result, bending of the tube-like material occurred within one week, so that it was impossible to make a fixing operation any more.

What is claimed is:

1. An image fixing apparatus comprising a drive roll, and an endless film facing the drive roll so as to in contact with the drive roll to thereby form a nip portion between the drive roll and the endless film, wherein the endless film is a thin tube-like material comprising: a heat-resistant resin tube-like inner layer containing heat-conductive particles; and a releasable resin outer layer formed on an outer surface of the heat-resistant resin tube-like inner layer, the releasable resin outer layer has a coating film hardness of not lower than 12 Hv in terms of Vickers hardness;

the thin tube-like material has a tensile modulus of elasticity of not smaller than 6000 $N/mm^2$, and the tube-like material has a ring-crash compression load of not higher than 5.0 g, the ring-crash compression load being a load which is given when a tube-like material having a length of 40 mm is compressed vertically so that a vertical diameter (h) of the tube-like material is deformed to be halved (h'=h/2).

2. An image fixing apparatus according to claim 1, wherein the drive roll is used as a pressure roll; a heat source is provided facing the inner surface of the endless film; and a non-fixed toner image is heated and fixed through the endless film at the nip portion formed between the drive roll and the endless film.

3. An image-fixing endless film, which comprises a thin tube-like material comprising: a heat-resistant resin tube-like inner layer containing heat-conductive particles; and a releasable resin outer layer formed on an outer surface of the heat-resistant resin tube-like inner layer, wherein the releasable resin outer layer has a coating film hardness of not lower than 12 Hv in terms of Vickers hardness;

the thin tube-like material has a tensile modulus of elasticity of not smaller than 6000 $N/mm^2$; and the tube-like material has a ring-crash compression load of not higher than 5.0 g, the ring-crash compression load being a load which is given when a tube-like material having a length of 40 mm is compressed vertically so that a vertical diameter (h) of the tube-like material is deformed to be halved (h'=h/2).

* * * * *